United States Patent [19]

Coulthard

[11] Patent Number: 4,604,047

[45] Date of Patent: Aug. 5, 1986

[54] FLARE FOR AND METHOD OF FLARING HIGH VELOCITY GAS

[75] Inventor: Leslie M. F. Coulthard, Sutton Coldfield, England

[73] Assignee: GKN Birwelco Limited, Halesowen, England

[21] Appl. No.: 589,735

[22] Filed: Mar. 15, 1984

[30] Foreign Application Priority Data

Mar. 19, 1983 [GB] United Kingdom ..... 8307687

[51] Int. Cl.[4] ..... F23D 14/58

[52] U.S. Cl. ..... 431/5; 431/202; 431/349

[58] Field of Search ..... 431/5, 202, 278, 286, 431/349, 284

[56] References Cited

U.S. PATENT DOCUMENTS

| | | | |
|---|---|---|---|
| 2,610,675 | 9/1952 | Downe | 431/349 |
| 2,869,631 | 1/1959 | Zink | 431/349 |
| 3,273,627 | 9/1966 | Zink et al. | 431/349 |
| 3,302,596 | 2/1967 | Zinn | 431/349 X |
| 3,529,915 | 9/1970 | Shoich et al. | 431/284 |
| 3,824,073 | 7/1974 | Straitz | 431/202 |
| 3,850,571 | 11/1974 | Zink et al. | 431/349 |
| 3,852,023 | 12/1974 | Itoh et al. | 431/202 |
| 4,105,394 | 8/1978 | Reed | 431/202 |
| 4,198,198 | 4/1980 | Straitz | 431/202 |

FOREIGN PATENT DOCUMENTS

| | | | |
|---|---|---|---|
| 1184713 | 1/1965 | Fed. Rep. of Germany | 431/349 |
| 798979 | 7/1958 | United Kingdom | 11001963/GBX |
| 1064926 | 4/1967 | United Kingdom . | |
| 1213848 | 11/1970 | United Kingdom . | |
| 1249967 | 10/1971 | United Kingdom . | |
| 1272963 | 5/1972 | United Kingdom . | |
| 1460576 | 6/1977 | United Kingdom . | |
| 1475959 | 6/1977 | United Kingdom . | |
| 2012407 | 8/1979 | United Kingdom . | |
| 2021250 | 11/1979 | United Kingdom . | |
| 1559653 | 1/1980 | United Kingdom . | |
| 2011061 | 3/1982 | United Kingdom . | |
| 2100414 | 12/1982 | United Kingdom . | |

*Primary Examiner*—Margaret A. Focarino

*Attorney, Agent, or Firm*—Marshall, O'Toole, Gerstein, Murray & Bicknell

[57] ABSTRACT

Method and apparatus for flaring high velocity gas, especially of sonic order, by burning in the vicinity 48 of the gas outlet 41 a low velocity gas in a stable energetic flame able to maintain combustion of the main flame even under considerable lift off, i.e., to a distance greater than is maintainable by a conventional pilot or flame retention device. The low pressure gas is derived at least in part 43, 36 as a portion 44 of the high pressure gas supply having been expanded to low pressure.

12 Claims, 9 Drawing Figures

FLARE FOR AND METHOD OF FLARING HIGH VELOCITY GAS

BACKGROUND OF THE INVENTION

This invention relates to the disposal of flammable gases by flaring.

Large quantities of unwanted flammable gas can be burnt quickly at flares of open pipe type. The gas may be supplied to such a flare at high pressure and released at high velocity, possibly sonic velocity, and one problem which arises, especially above about half sonic velocity, is that the flame can lift off the tip of the flare, so that ignition of the gas occurs at some distance from the tip of the flare. Whilst lift off is not in itself a problem, indeed, a lifted flame benefits from improved aeration, there is the possibility that the flame may be unstable and lift off to the extent that the flame is blown out, which leads to the dangerous accumulation of unburnt flammable gas. Flares may be fitted with pilot burners or flame retention devices in an attempt to maintain ignition at lift off, the former of which provide a small stable flame supplied with fuel gas from an independent source, and the latter of which operate by establishing regions of low gas velocity at the flare tip and small stable flames, which provide a continuous re-ignition source for the main flame at the flare tip if it tends to lift off the tip. However, at high gas velocities, and particularly those of or approaching sonic velocity such small flames are not sufficient for reliable flame retention and cannot provide continuity of ignition of the main flame if it is lifted to any great extent. It is an advantage if the flare can be operated with a gas velocity of the sonic order, since, inter alia, lower radiation of energy from the flame can be achieved.

SUMMARY OF THE INVENTION

It is therefore an object of the invention to provide a method of flaring gas supplied at high pressure and released at high velocity in which ignition of the gas is maintained even when a considerable degree of flare lift-off occurs.

It is also an object of the invention to provide a flare apparatus for use in accomplishing the said method.

According to one aspect of the invention, I provide in a method of flaring flammable gas supplied at high pressure from a supply and released at high velocity from a tip of an open pipe flare, wherein a quantity of gas at lower pressure and lower velocity than said supply is burnt at or adjacent the tip of said flare in one or more further outlets adapted to produce flares of sufficient size and energy to establish continuous ignition of the high velocity gas up to a considerable distance above the tip, the steps of:

Deriving a quantity of gas from said supply upstream of the tip of the flare;

expanding the derived quantity of gas to a pressure lower than said high pressure; and utilising said expanded derived gas to provide at least a part of said lower pressure, lower velocity gas.

By a considerable distance, I mean a distance greater, preferably a number of times greater, than that over which ignition can be maintained by the use of a conventional pilot flame or flame retention device, typically at least and generally well in excess of, 1.5 meters or more.

The use of one or more further outlets burning gas at lower pressure than that which is burnt in the main flare, and arranged to produce flames of relatively great size and energy, in comparison with the flames produced by conventional pilot burners or flame retention devices, will be much more effective at maintaining stability of a lifted flame, even a flame considerably lifted, than flame retention devices used hitherto. Because the low pressure gas is burnt at low velocity, it itself is not subject to lift off and is inherently stable.

According to another aspect of the invention, I provide flare apparatus for burning inflammable gas supplied at a high pressure, comprising at least one flare tip from which said gas supplied is released, means for deriving some of said gas from the supply thereof at a position upstream of the flare tip, means for expanding such derived gas to a pressure lower than the pressure of said gas supplied, and at least one further outlet arranged to burn said lower pressure gas at or adjacent said flare tip and adapted to produce flames of sufficient size and energy to establish continuous ignition of the high velocity gas up to a considerable distance above the tip.

The apparatus may also comprise a manifold supplied with said lower pressure gas and supplying a plurality of individual outlets disposed around the tip of the main flare. By this means, at least one of the further flares will be to windward of the main flare so that ignition of the main quantity of gas at or above the flare tip occurs reliably even under windy conditions.

Alternatively, a further outlet of annular form at the flare tip may be employed.

As yet a further alternative, the high velocity gas may be burnt in a plurality of individual flares which may include some flares burning only said low pressure gas, or may be disposed around an outlet burning said lower pressure gas. It is also be possible to make use of the invention where one or more high pressure flares is disposed in close proximity to a low pressure flare whose source of low pressure gas is separate from the gas source for the high pressure flare or flares. One advantage of such an arrangement is that the presence of the high pressure gas flares improves the combustion of the low pressure gas flare and reduces the quantity of smoke produced. However, although the low pressure flare may provide for stable operation of the high pressure flares in the lifted-off condition, if the supply of gas to the low pressure flare fails such stability cannot be ensured. Advantageously and accordingly to the invention the low pressure flare is arranged to be additionally supplied with gas derived from the high pressure flare and expanded to low pressure. Thus there is a flame available from the low pressure flare to stabilise the high pressure flare whenever the latter is operating, even if the flow of low pressure gas from the separate source ceases.

Gas derived from the high pressure flare and gas drawn from a separate low pressure source, may be released from common outlets, separate outlets or a combination of common and separate outlets.

DETAILED DESCRIPTION OF THE DRAWINGS

Figure 6:
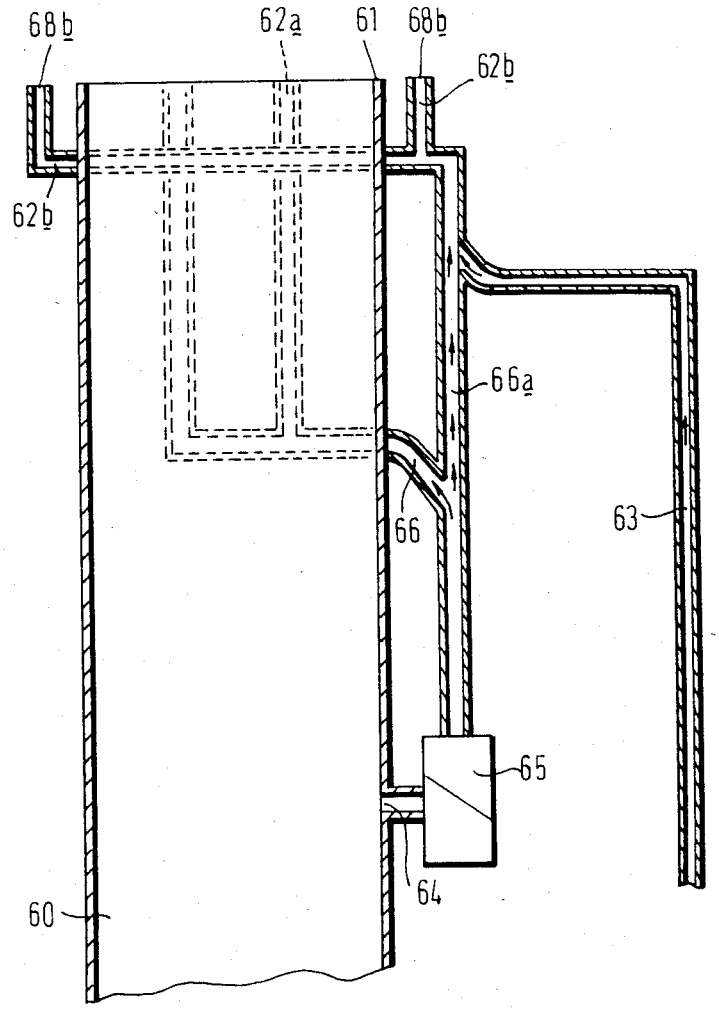
Figure 8:
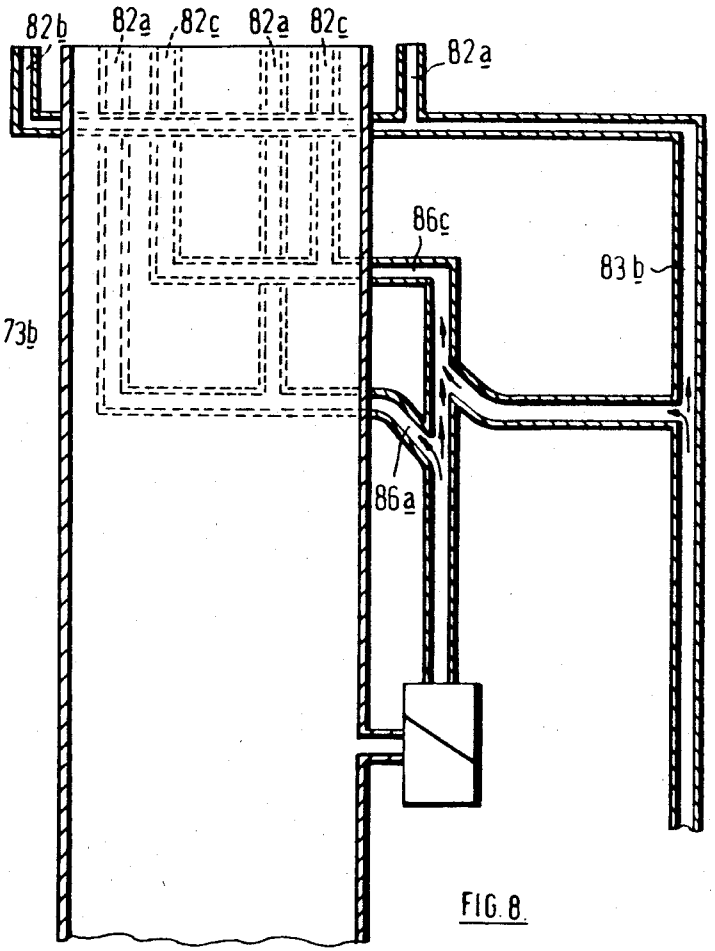
Figure 7:
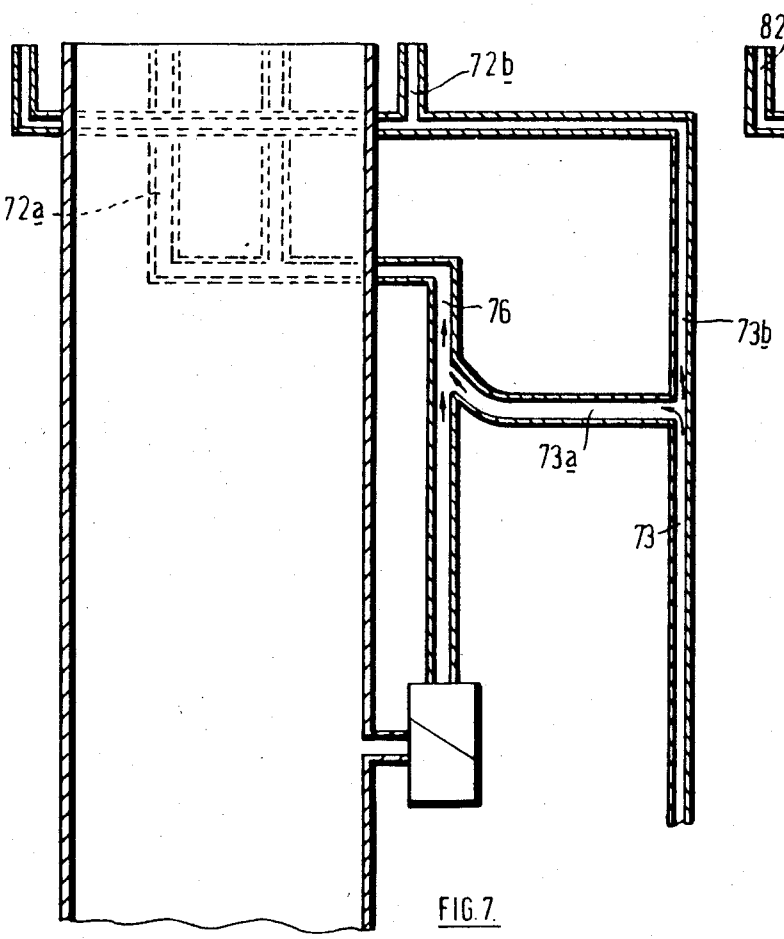
Figure 9:
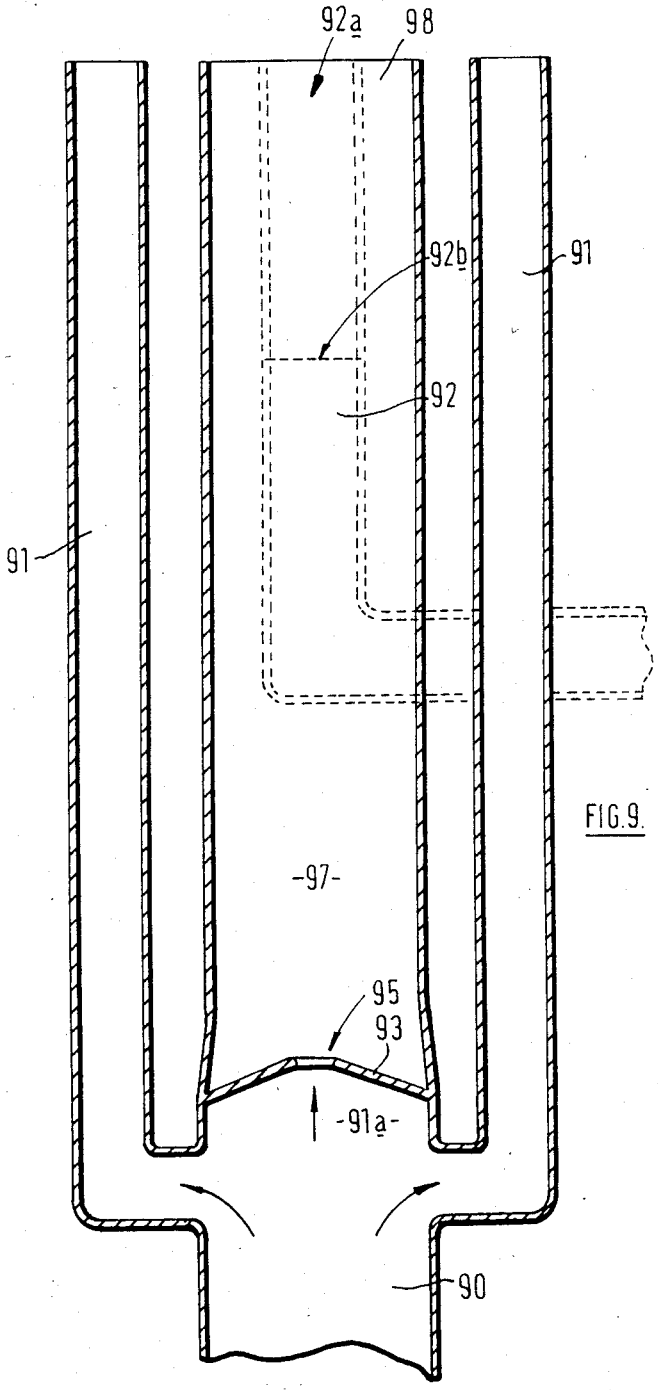

FIG. 6 is a diagrammatic part cross-sectional view of a sixth embodiment of the invention in which a part of the low pressure gas is provided from a portion of the high pressure supply and a part from a separate source, a portion of the part derived from the high pressure supply being released from outlets shared with the part derived from the separate source, and another portion thereof being released from separate outlets;

FIG. 7 is a diagrammatic part cross-sectional view of a seventh embodiment of the invention in which a part of the low pressure gas is provided from a portion of the high pressure supply and a part from a separate source, the part derived from the high pressure supply being released from outlets shared with some of the part derived from the separate supply, the remainder of the latter being released from separate outlets;

FIG. 8 is a diagrammatic part cross-sectional view of an eighth embodiment of the invention in which a part of the low pressure gas is provided from a portion of the high pressure supply and a part from a separate supply, some of the former and some of the latter being released from common outlets and the remainder of the former and the latter being released from respective separate outlets;

FIG. 9 is a diagrammatic part cross-sectional view of a ninth embodiment of the invention in which a low pressure gas outlet is surrounded by a plurality of outlets for high pressure, high velocity gas.

DETAILED DESCRIPTION OF PREFERRED EMBODIMENTS

Figure 1:
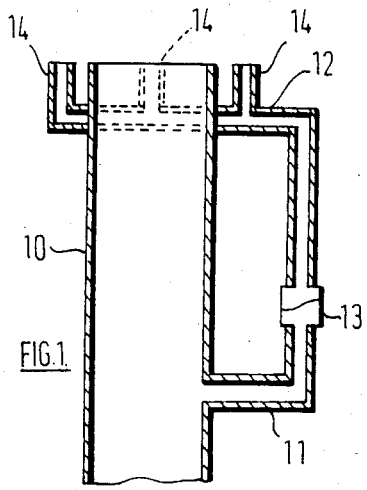
FIG. 1 is a diagrammatic part cross-sectional view of a first embodiment of the invention in which the low pressure gas is derived wholly from a portion of the high pressure gas supply.
Figure 2:
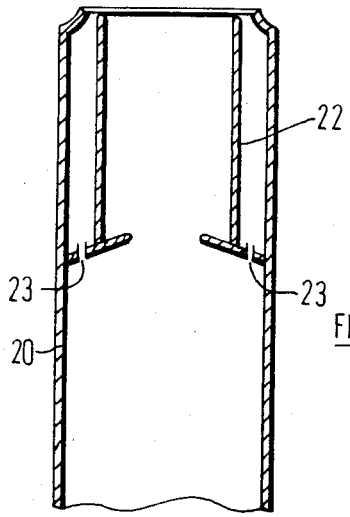
FIG. 2 is a diagrammatic part cross-sectional view of a second embodiment of the invention in which the low pressure gas is derived wholly from a portion of the high pressure gas supply.
Figure 3:
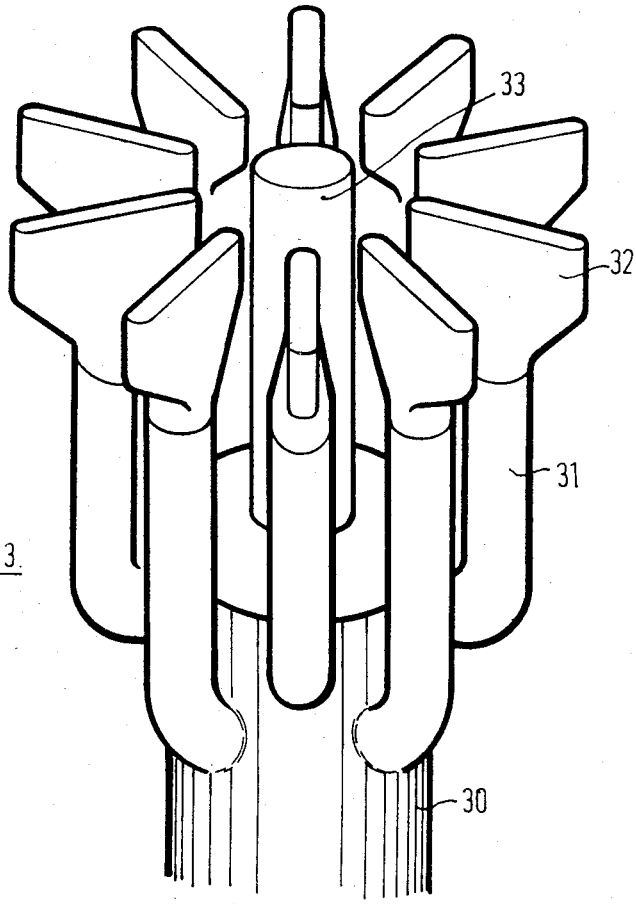
FIG. 3 is a schematic perspective view of a third embodiment of the invention in which the low pressure gas is derived wholly from a portion of the high pressure gas supply.

In the embodiment of FIGS. 1 to 3 all the low pressure gas is derived from the high pressure gas supply. Referring firstly to FIG. 1, there is shown an open pipe flare 10. Upstream of the tip of the flare 10, there is a passage 11 by which a proportion of the main flow of gas to the tip of flare 10 is supplied to a manifold 12 by way of a restriction 13 so that the gas pressure and velocity in manifold 12 is less than that in the flare 10. The manifold 12 feeds a plurality of individual outlets 14 disposed around the tip of flare 10 and arranged to produce flames which are of sufficient size and energy to ensure continuous ignition of gas at a distance of at least 1.5 m above the tip of the flare.

In the embodiment of FIG. 2, a flare 20 has, up stream of its tip, a baffle plate 21 whose purpose is to provide a baffle seal to resist entry of air into the flare upstream thereof which could give rise to an explosive mixture in the flare when it is not actually flaring. Downstream of the baffle plate 21, the flare tip contains an internal tube 22 which defines an annular region communicating with the flare up-stream of baffle plate 21 by passages 23 extending through the plates. If the flare is supplied with gas at high pressure, the annular space out side tube 22 will contain gas at a relatively lower velocity and pressure by virtue of the restrictions afforded by passages 23, which gas will emerge at a velocity such that an annular relatively stable flame is established around the main flame of the gas passing through the interior of tube 22. Again, this ensures ignition of the main supply of gas at or above the flare tip and ensures stability of the flame.

Referring now to FIG. 3 of the drawings, this shows a flare with a stack pipe 30 terminating in an annular array of pipes 31 having elongated mouths 32. In the centre of this array is a further outlet pipe 33 which is supplied with gas from the pipe 30 by way of a restriction in an analogous manner to that described above, so that the gas issuing from pipe 33 is expanded to a relatively low velocity and pressure compared with the main quantity of gas issuing from the pipes 31, 32. Again, the flame produced by pipe 33 is sufficient to ensure reliable ignition of gas even at a distance above the mouths of pipes 32. Stable combustion is thus achieved, even when the flames of the high velocity gas are lifted off their flare tips.

The embodiment of FIG. 3 is advantageous in that it allows maximum access of air to the streams of high velocity gas. In addition, the central flame of low velocity gas is to an extent shielded from wind by the surrounding high velocity gas streams.

Figure 4:
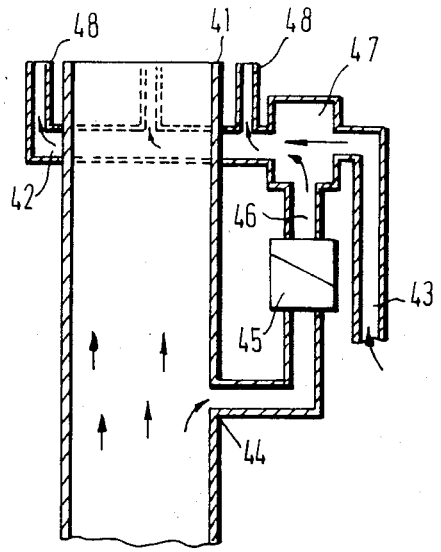
FIG. 4 is a diagrammatic part cross-sectional view of a fourth embodiment of the invention in which a part of the low pressure gas is provided from a portion of the high pressure supply and a part from a separate source, both parts being released from common outlets.

The embodiment of FIG. 4 comprises a flare stack pipe 40 for high pressure gas of sonic velocity, surrounded at its flare tip 41 by an annular manifold 42 for lower pressure, lower velocity gas. The latter is derived in part from a source (not shown) separate from the high pressure gas supply via a conduit 43 and in part by gas withdrawn from the high pressure supply from a point 44 up stream of the flare tip 41. The withdrawn gas is expanded in an expansion chamber 45 and supplied via a conduit 46 to a mixing chamber 47 where it mixes with gas from conduit 43 before being released from outlets 48 of said manifold 42.

Figure 5:
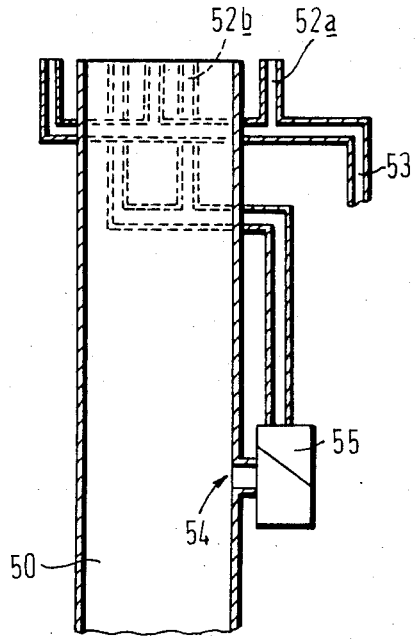
FIG. 5 is a diagrammatic part cross-sectional view of a fifth embodiment of the invention in which a part of the low pressure gas is provided from a portion of the high pressure supply and a part from a separate source, each part being released from separate outlets.

The embodiment of FIG. 5 comprises a flare stack pipe 50 and two manifolds each having outlets for low pressure gas, one manifold **52*a* being supplied from a separate source (not shown) in a conduit 53 and the second separate manifold 52*b* (shown in broken lines) being supplied only with gas withdrawn from the high pressure supply at a point 54 and expanded in expansion chamber 55** in a manner similar to that of the fourth embodiment.

The sixth embodiment shown in FIG. 6 comprises a flare stack pipe 60 and two manifolds for low pressure gas arranged in the vicinity of the flare tip 61. The first manifold **62*a* (shown only in broken lines) is supplied via a pipe 66 only with gas withdrawn from the high pressure supply at a point 64 upstream of the flare tip 61 and expanded in expansion chamber 65. Some of said expanded withdrawn gas is conducted along a further pipe 66*a* where it is joined by low pressure gas derived from a separate source (not shown) via a conduit 63 and passes to a second manifold 62*b* from outlets 68*b*** of which it is released.

The seventh embodiment is similar to the sixth except that all of the expanded withdrawn gas is conducted to a first manifold **72*a* (shown in broken lines) via a conduit 76 where it mixes with some low pressure gas derived from the spearate source via a branch 73*a* of a conduit 73. Further gas derived from the separate source passes along a conduit branch 73***b* to a second manifold 72*b*.

In the eighth embodiment there are three low pressure gas manifolds, a first one 82*a* supplied only with a portion of the expanded withdrawn gas via a conduit 86*a*, a second one 82*b* supplied only with a portion of gas derived from a separate source via conduit 83*b*, and a third manifold 82*c* supplied with the remainder of the expanded withdrawn gas and the gas derived from the said source, via conduit 86*c*.

In the ninth embodiment shown in FIG. 9, the apparatus comprises a conduit 90 supplying high pressure high velocity gas the conduit branching into a plurality (only two of which are shown) of branch conduits 91 for high pressure high velocity gas, and a central conduit 91*a* within which is situated an orifice plate 93. Some of the high pressure gas passes through the orifice 95 of this plate and is then expanded in the expansion chamber 97 before being burnt at an outlet 98 of the latter, with a large energetic flame. There may be provided a conduit 92 (shown in broken line) in this instance concentric with the conduit 91*a*, supplied with low pressure gas from an independent source to supplement the gas expanded in chamber 97. The said conduit may terminate at the same level 92*a* as the conduit 91*a* to keep the low pressure gases separate or may terminate short thereof 92*b* so that mixing of the low pressure gases occurs before combustion. The low pressure conduit 92 may be provided externally of conduit 91*a* in a similar manner to the fifth to eighth embodiments.

By way of example only, the amount of gas burned at low pressure and velocity may be of the order of 10% of the total quantity of gas passing to the flare, and it may issue from the further outlet at a velocity of the order of 20% of the velocity of the high velocity gas.

The flares above described are preferably all provided with conventional pilot burners or the like for initial ignition.

In the embodiments described flow restriction valves, non-return valves, shut-off valves and other flow control devices may be used in known manner to provide for proper control and guidance of the low pressure and high pressure gases.

The portion taken may be typically of the order of 10% by volume of the said supply but will depend on circumstances and would normally be 5–15% by volume. The size of the portion taken is desirably kept to a minimum so that as much gas as possible is burnt at high velocity to minimise radiation energy.

The velocity at which the low pressure, low velocity gas is released will be generally less than half sonic velocity, typically 10–330 m.s.$^{-1}$ and preferably about 0.2 sonic velocity (about 220 m.s.$^{-1}$).

Having described the invention, what I claim is:

1. In a method of flaring flammable gas supplied at high pressure from a supply and released at high velocity from a tip of an open pipe flare, wherein a quantity of gas at lower pressure and lower velocity than said supply is burnt at or adjacent the tip of said flare in one or more further outlets adapted to produce flares of sufficient size and energy to establish continuous ignition of the high velocity gas up to a considerable distance above the tip, the steps of:

deriving a quantity of gas from said supply upstream of the tip of the flare;

expanding the derived quantity of gas to a pressure lower than said high pressure;

utilizing said expanded derived gas to provide at least a part of said lower pressure, lower velocity gas; and mixing at least a part of said withdrawn gas with at least part of a stream of low pressure flammable gas, from a source independent of the high pressure supply, to provide at least part of said lower pressure, lower velocity gas.

2. In a method of flaring flammable gas supplied at high pressure from a supply and released at high velocity from a tip of an open pipe flare, wherein a quantity of gas at lower pressure and lower velocity than said supply is burnt at or adjacent the tip of said flare in one or more further outlets adapted to produce flares of sufficient size and energy to establish continuous ignition of the high velocity gas up to a considerable distance above the tip, the steps of:

deriving a quantity of gas from said supply upstream of the tip of the flare;

expanding the derived quantity of gas to a pressure lower than said high pressure;

utilizing said expanded derived gas to provide at least a part of said lower pressure, lower velocity gas; and taking low pressure flammable gas from a source separate from said high pressure supply to provide a part of said lower pressure, lower velocity gas.

3. Open pipe flare apparatus for burning flammable gas supplied at high pressure and released at high velocity at at least one flare outlet tip, the flare apparatus comprising:

at least one further outlet for gas supplied at a velocity and pressure lower than the velocity and pressure of the gas released at the open pipe flare tip(s), the further outlet(s) being arranged such that the lower pressure, lower velocity gas is burnt in the vicinity of the open pipe flare tip(s) to produce stable flares of sufficient size and energy to establish continuous ignition of the high velocity gas up to a considerable distance above the flare tip(s);

means for deriving some of said high pressure high velocity gas from the supply thereof at a position upstream of the flare tip(s);

expansion means for expanding said derived gas to a lower pressure to provide at least a part of said lower pressure, lower velocity gas;

conduit means for supplying said expanded derived gas from the expansion means to the or at least one of the said further outlets(s);

further conduit means communicating with a source of low pressure flammable gas separate from said high pressure supply; and, the or all of the said further outlets(s) also communicating with said source via said further conduit means.

4. Open pipe flare apparatus for burning flammable gas supplied at high pressure and released at high velocity at at least one flare outlet tip, the flare apparatus comprising:

a plurality of further outlets for gas supplied at a velocity and pressure lower than the velocity and pressure of the gas released at the open pipe flare tip(s);

the further outlets being arranged such that the lower pressure, lower velocity gas is burnt in the vicinity of the open pipe flare tip(s) to produce stable flares of sufficient size and energy to establish continuous ignition of the high velocity gas up to a considerable distance above the flare tip(s);

means for deriving some of said high pressure high velocity gas from the supply thereof at a position upstream of the flare tip(s);

expansion means for expanding said derived gas to a lower pressure to provide at least a part of said lower pressure, lower velocity gas;

conduit means for supplying said expanded derived gas from the expansion means to the plurality of further outlets;

further conduit means communicating with a source of flammable low pressure gas separate from the high pressure supply; and at least one of said further outlets communicating with said expansion means and supplied only with said expanded derived gas via said conduit means, and the other(s) of said further outlets communicating with said further conduit means and being supplied only with said low pressure gas.

5. Open pipe flare apparatus for burning flammable gas supplied at high pressure and released at high velocity at at least one flare outlet tip, the flare apparatus comprising:

a plurality of further outlets for gas supplied at a velocity and pressure lower than the velocity and pressure of the gas released at the open pipe flare tip(s);

the further outlets being arranged such that the lower pressure, lower velocity gas is burnt in the vicinity of the open pipe flare tip(s) to produce stable flares of sufficient size and energy to establish continuous ignition of the high velocity gas up to a considerable distance above the flare tip(s);

means for deriving some of said high pressure high velocity gas from the supply thereof at a position upstream of the flare tip(s);

expansion means for expanding said derived gas to a lower pressure to provide at least a part of said lower pressure, lower velocity gas;

conduit means for supplying said expanded derived gas from the expansion means to the plurality of further outlets;

further conduit means communicating with a source of flammable low pressure gas separate from the high pressure supply; and at least one of said further outlets communicating with said expansion means and supplied only with said expanded derived gas via said conduit means, and the other(s) of said further outlet means communicating with said conduit means and the further conduit means and being supplied with a mixture of said expanded derived gas and said low pressure gas.

6. Open pipe flare apparatus for burning flammable gas supplied at high pressure and released at high velocity at at least one flare outlet tip, the flare apparatus comprising:

a plurality of further outlets for gas supplied at a velocity and pressure lower than the velocity and pressure of the gas released at the open pipe flare tip(s);

the further outlets being arranged such that the lower pressure, lower velocity gas is burnt in the vicinity of the open pipe flare tip(s) to produce stable flares of sufficient size and energy to establish continuous ignition of the high velocity gas up to a considerable distance above the flare tip(s);

means for deriving some of said high pressure high velocity gas from the supply thereof at a position upstream of the flare tip(s);

expansion means for expanding said derived gas to a lower pressure to provide at least a part of said lower pressure, lower velocity gas;

conduit means for supplying said expanded derived gas from the expansion means to the plurality of further outlets;

further conduit means communicating with a source of flammable low pressure gas separate from the high pressure supply; and at least one of said further outlets communicating with said conduit means and further conduit means and being supplied with a mixture of said expanded derived gas and low pressure gas, and the other(s) of said further outlets communicating with said further conduit means and being supplied only with said low pressure gas.

7. Open pipe flare apparatus for burning flammable gas supplied at high pressure and released at high velocity at at least one flare outlet tip, the flare apparatus comprising:

a plurality of further outlets for gas supplied at a velocity and pressure lower than the velocity and pressure of the gas released at the open pipe flare tip(s);

the further outlets being arranged such that the lower pressure, lower velocity gas is burnt in the vicinity of the open pipe flare tip(s) to produce stable flares of sufficient size and energy to establish continuous ignition of the high velocity gas up to a considerable distance above the flare tip(s);

means for deriving some of said high pressure high velocity gas from the supply thereof at a position upstream of the flare tip(s);

expansion means for expanding said derived gas to a lower pressure to provide at least a part of said lower pressure, lower velocity gas;

conduit means for supplying said expanded derived gas from the expansion means to the plurality of further outlets;

further conduit means communicating with a source of flammable low pressure gas separate from the high pressure supply;

at least one of said further outlets communicating with said expansion means and supplied only with said expanded derived gas via said conduit means, and the other(s) of said further outlet means communicating with said conduit means and the further conduit means and being supplied with a mixture of said expanded derived gas and said low pressure gas; and others of the further outlets communicating with the further conduit means and being supplied only with said low pressure gas.

8. In a method of flaring flammable gas supplied at high pressure from a supply and released at high velocity of sonic order from a tip of an open pipe flare, wherein a quantity of gas at lower pressure and lower velocity than said supply is burnt at or adjacent the tip of said flare in one or more further outlets adapted to produce flares of sufficient size and energy to establish continuous ignition of the high velocity gas up to a considerable distance above the tip, the steps of:

deriving a quantity of gas from said supply upstream of the tip of the flare;

expanding the derived quantity of gas to a pressure lower than said high pressure;

utilizing said expanded derived gas to provide at least a part of said lower pressure, lower velocity gas; and wherein the portion of said high pressure gas derived to provide said lower pressure, lower velocity gas is 5–15% by volume of said supply.

9. In a method of flaring flammable gas supplied at high pressure from a supply and released at high velocity of sonic order from a tip of an open pipe flare, wherein a quantity of gas at lower pressure and lower velocity than said supply is burnt at or adjacent the tip of said flare in one or more further outlets adapted to produce flares of sufficient size and energy to establish continuous ignition of the high velocity gas up to a considerable distance above the tip, the steps of:

deriving a quantity of gas from said supply upstream of the tip of the flare;

expanding the derived quantity of gas to a pressure lower than said high pressure;

utilizing said expanded derived gas to provide at least a part of said lower pressure, lower velocity gas; and wherein the low pressure low velocity gas is released at a velocity in the range 10–330 $m.s.^{-1}$.

10. In a method of flaring flammable gas supplied at high pressure from a supply and released at high velocity of sonic order from a tip of an open pipe flare, wherein a quantity of gas at lower pressure and lower velocity than said supply is burnt at or adjacent the tip of said flare in one or more further outlets adapted to produce flares of sufficient size and energy to establish continuous ignition of the high velocity gas up to a considerable distance above the tip, the steps of:

deriving a quantity of gas from said supply upstream of the tip of the flare;

expanding the derived quantity of gas to a pressure lower than said high pressure;

utilizing said expanded derived gas to provide at least a part of said lower pressure, lower velocity gas; and wherein the low pressure low velocity gas is released at a velocity of the order of 0.2 sonic velocity.

11. Open pipe flare apparatus for burning flammable gas supplied at high pressure and released at high velocity of sonic order at at least one flare outlet tip, the flare apparatus comprising, at least one further outlet for gas supplied at a velocity and pressure lower than the velocity and pressure of the gas released at the open pipe flare tip(s), the further outlet(s) being arranged such that the lower pressure, lower velocity gas is burnt in the vicinity of the open pipe flare tip(s) to produce stable flares of sufficient size and energy to establish continuous ignition of the high velocity gas up to a considerable distance above the flare tip(s);

means for deriving some of said high pressure high velocity gas from the supply thereof at a position upstream of the flare tip(s);

expansion means for expanding said derived gas to a lower pressure to provide at least a part of said lower pressure, lower velocity gas;

conduit means for supplying said expanded derived gas from the expansion means to the or at least one of the said further outlets(s); and wherein the said further outlet(s) are disposed within an array of said open pipe flare tips releasing high velocity gas.

12. Open pipe flare apparatus as claimed in claim 11 wherein there is provided a circular array of said open pipe flare tips releasing high velocity gas, and one of said further outlets is disposed at the center of said array.

* * * * *